US007776189B2

(12) United States Patent
Shrivastava et al.

(10) Patent No.: US 7,776,189 B2
(45) Date of Patent: Aug. 17, 2010

(54) METHOD AND APPARATUS FOR ELECTROPOLISHING METALLIC STENTS

(75) Inventors: Sanjay Shrivastava, Mountain View, CA (US); Frank Moloney, Ballybane (IE); Travis Yribarren, San Mateo, CA (US); Jeffrey Farina, Zionsville, PA (US); John Thomas, Berwyn, PA (US); James Young, Phoenixville, PA (US)

(73) Assignees: Abbott Laboratories, Abbott Park, IL (US); Accelent Inc., Wilmington, MA (US)

( * ) Notice: Subject to any disclaimer, the term of this patent is extended or adjusted under 35 U.S.C. 154(b) by 1167 days.

(21) Appl. No.: 11/370,642

(22) Filed: Mar. 7, 2006

(65) Prior Publication Data

US 2007/0209947 A1 Sep. 13, 2007

(51) Int. Cl.
*B23H 3/04* (2006.01)
*C25D 21/00* (2006.01)

(52) U.S. Cl. ..... 204/199; 204/212; 204/213; 204/286.1; 205/640; 205/686

(58) Field of Classification Search ..... 204/199, 204/212, 213, 286.1; 205/640, 686
See application file for complete search history.

(56) References Cited

U.S. PATENT DOCUMENTS 5,858,556 A 1/1999 Eckert et al. ..... 428/586
6,599,415 B1 7/2003 Ku et al.
6,679,980 B1 1/2004 Andreacchi ..... 204/272
7,498,062 B2 * 3/2009 Calcaterra et al. ..... 427/430.1
7,501,048 B2 * 3/2009 Loermans et al. ..... 204/202
2005/0098444 A1 5/2005 Schaeffer
2005/0263171 A1 * 12/2005 Wu et al. ..... 134/6
2005/0263717 A1 12/2005 Soluri et al.
2005/0288773 A1 12/2005 Glocker et al.
2007/0034527 A1 * 2/2007 Diaz et al. ..... 205/686

OTHER PUBLICATIONS

International Search Report and Written Opinion of the International Searching Authority dated Sep. 26, 2007, for related PCT Application No. PCT/US2007/05844.

* cited by examiner

*Primary Examiner*—Harry D. Wilkins, III
*Assistant Examiner*—Nicholas A. Smith
(74) *Attorney, Agent, or Firm*—Workman Nydegger; Jonathan Feuchtwang

(57) ABSTRACT

An apparatus and method are provided for simultaneously electropolishing a plurality of metallic stents. A plurality of elongated members on the apparatus are movably engaged with a plate such that movement of the plate relative to the elongated members causes each of the elongated members to rotate on its respective longitudinal axis when immersed in an electrolytic solution. A continuous cathode is located in close proximity to each of the elongated members when they are immersed in the electrolytic solution.

16 Claims, 6 Drawing Sheets

METHOD AND APPARATUS FOR ELECTROPOLISHING METALLIC STENTS

RELATED APPLICATION

This application is related to the application entitled "Method of Descaling Metallic Devices" by inventor Sanjay Shrivastava, filed on the same date herewith.

BACKGROUND OF THE INVENTION

The present invention relates generally to providing an apparatus and method for electropolishing products made from metals, and in particular, electropolishing metallic medical devices such as stents, made of stainless steel, titanium, tungsten, nickel-titanium, tantalum, cobalt-chromium-tungsten, etc. While the apparatus and method are described herein as being applicable mainly to medical stents, in particular intravascular stents, the invention is not limited to such medical products. For example, the methods may be applied to electropolish metallic automotive or aerospace components.

Stents are generally tube-shaped intravascular devices placed within a blood vessel to maintain the patency of the vessel and, in some cases, to reduce the development of restenosis. The stents may be formed in a variety of configurations which are typically expandable since they are delivered in a compressed form to the desired site. Such a configuration may be a helically wound wire, wire mesh, weaved wire, serpentine stent, or a chain of rings. The walls of stents are typically perforated in a framework design of wire-like connected elements or struts or in a weave design of cross-threaded wire. Some stents are made of more than one material. The stent may be, for example, a sandwich of metals having outer layers of a biocompatible material, such as stainless steel, with an inner layer providing the radioopacity to the stent needed for tracking by imaging devices during placement. A stent made of such material may be, for example, a thin layer of titanium between layers of stainless steel. In forming such stents from metal, a roughened outer surface of the stent may result from the manufacturing process. It is desirable for the surface of the stent to be smooth so that it can be easily inserted and traversed with low friction through the blood vessels toward the site of implantation. A rough outer surface may not only cause increased frictional obstruction, but may also damage the lining of the vessel wall during insertion. Furthermore, smooth surfaces decrease the probability of thrombogenesis and corrosion.

Since the processing to form metallic stents often results in a product initially having undesirable burrs, sharp ends or debris and slag material from melting the metal during processing, as a first order treatment of the product, descaling of the surface is required in preparation of further surface treatment such as electropolishing.

The present invention is directed to an apparatus and method for electropolishing such stents after they have been descaled by an appropriate method, such as that disclosed in concurrently filed application Ser. No. 11/370,660. Descaling may include, for example, dipping the stent into a strongly acidic solution and thereafter ultrasonically cleaning the stent.

Electropolishing is an electrochemical process by which some of the surface metal is electrolytically dissolved. In general, the metal stent serves as an anode and is connected to a power supply while immersed in an electrolytic solution having a metal cathode connected to the negative terminal of the power supply. Current therefore flows from the stent, as the anode, causing it to become polarized. The rate at which the metal ions on the stent are dissolved is controlled by the applied and/or voltage. The positioning of the cathode relative to the stents is important so that there is an even distribution of current to the stent. According to the theory of electropolishing, the current density is highest at high points protruding from a surface and is lowest at the surface low points. Thus, the higher current density at the raised points causes the metal to dissolve faster at these points which thus levels the surface. Electropolishing therefore serves to smooth the surface, typically to the point where it is shiny and reflective.

The present invention provides an apparatus and process for electropolishing a plurality of metallic devices such as stents simultaneously to consistently produce smooth surfaces.

SUMMARY OF THE DISCLOSURE

An apparatus is provided for simultaneously electropolishing a plurality of metallic stents comprising:

a plurality of elongated members having a longitudinal axis, each of the members comprising an electrically conductive adaptor capable of being removably affixed to and in electrical contact with a metallic stent wherein each of the elongated members is independently rotatable on its respective longitudinal axis;

each of the elongated members being moveably engaged with a plate such that movement of the plate relative to the elongated members causes each of the elongated members to rotate on its respective longitudinal axis;

a motorized driver to produce the movement;

an electrolytic solution;

a continuous cathode configured to be located in close proximity to each of the elongated members when the elongated members and cathode are immersed in the electrolytic solution;

a cathode current conducting member attached to said cathode; and an anode current conducting member wherein each of the elongated members is conductively connected electrically with the anode current conducting member.

In one embodiment, the plate is stationary and the elongated members are accommodated by a moveable second plate capable of rotating about an axis substantially parallel to the axes of the elongated members and the motorized driver is engaged with the second plate.

In another embodiment, the plate is moveable and is engaged with the motorized driver and the elongated members are accommodated by a stationary second plate.

In yet another embodiment, the apparatus further comprises a second continuous cathode configured to be located in close proximity to each of the elongated members when the elongated members and cathode are immersed in the electrolytic solution and a second cathode current conducting member attached to the second cathode.

In a further embodiment, the two cathodes are tubular in shape and disposed substantially concentrically in the solution.

A method is also provided for simultaneously electropolishing a plurality of metallic stents comprising the steps of:

a) affixing a stent on each of one or more electrically conductive adaptors of an apparatus, the apparatus comprising:

a plurality of elongated members having a longitudinal axis, each of the members comprising an electrically conductive adaptor capable of being removably affixed to and in electrical contact with a metallic stent wherein each of the elongated members is independently rotatable on its respective longitudinal axis;

each of the elongated members being moveably engaged with a plate such that movement of the plate relative to the elongated members causes each of the elongated members to rotate on its respective longitudinal axis;

a motorized driver to produce the movement;

an electrolytic solution;

a continuous cathode configured to be located in close proximity to each of the elongated members when the elongated members and cathode are immersed in the electrolytic solution;

a cathode current conducting member attached to the cathode;

an anode current conducting member wherein each of the elongated members is conductively connected electrically with the anode current conducting member;

b) immersing said stents into the electrolytic solution and rotating each of the elongated members on its respective longitudinal axis by activation of the motorized driver;

c) supplying a voltage difference between the cathode current conducting member and the anode current conducting member;

d) removing the stents from the solution and rinsing with alcohol;

e) optionally, repeating steps b), c) and d).

In one embodiment, the method further comprises the steps of f) removing the stents from the apparatus;

g) rinsing the stents;

h) immersing the stents in a passivation solution;

i) removing the stents from the passivation solution and rinsing; and j) placing the stents in a liquid and applying ultrasound energy to the liquid.

In one embodiment, the electrolytic solution comprises about 4 vol. % ethylene glycol, about 10 vol. % sulfuric acid and about 86 vol. % methanol.

In another embodiment, in step c) the voltage is supplied for a period in the range of about 25 to 50 seconds while the stents are immersed in the electrolytic solution.

In a preferred embodiment, steps b), c) and d) are repeated three times.

In an embodiment, the passivation solution comprises nitric acid.

In yet another embodiment, the ultrasound energy is applied for a period of about 2 minutes to the liquid at a temperature in the range of about 50° to 60° C.

DETAILED DESCRIPTION

The present invention is directed to an apparatus and method for electropolishing a plurality of metallic devices, in particular, metallic stents. The present invention is advantageous not only in that a plurality of devices can be simultaneously electropolished, but also that by providing rotation of each of the stents located in equivalent positions in close proximity to a continuous cathode, the stents, serving as anodes, are uniformly electropolished.

In one embodiment of the invention, the individual stents, in addition to being rotated within the electropolishing solution adjacent to the cathode, are also displaced along the cathode by rotation on a movable plate to which they are attached. This provides not only agitation of the electropolishing solution, but also ensures uniform exposure of each of the stents, as anodes, to the same cathode surface, thus averaging out any current collecting differences which may exist between different portions of the electrode surface.

In yet another embodiment, the stents, as anodes are rotated only on their individual axes and are attached to a stationary plate.

In yet another embodiment, the apparatus is provided with two concentric cathodes with the stents, as anodes, placed therebetween, thereby providing additional cathode surface area.

Figure 1A:
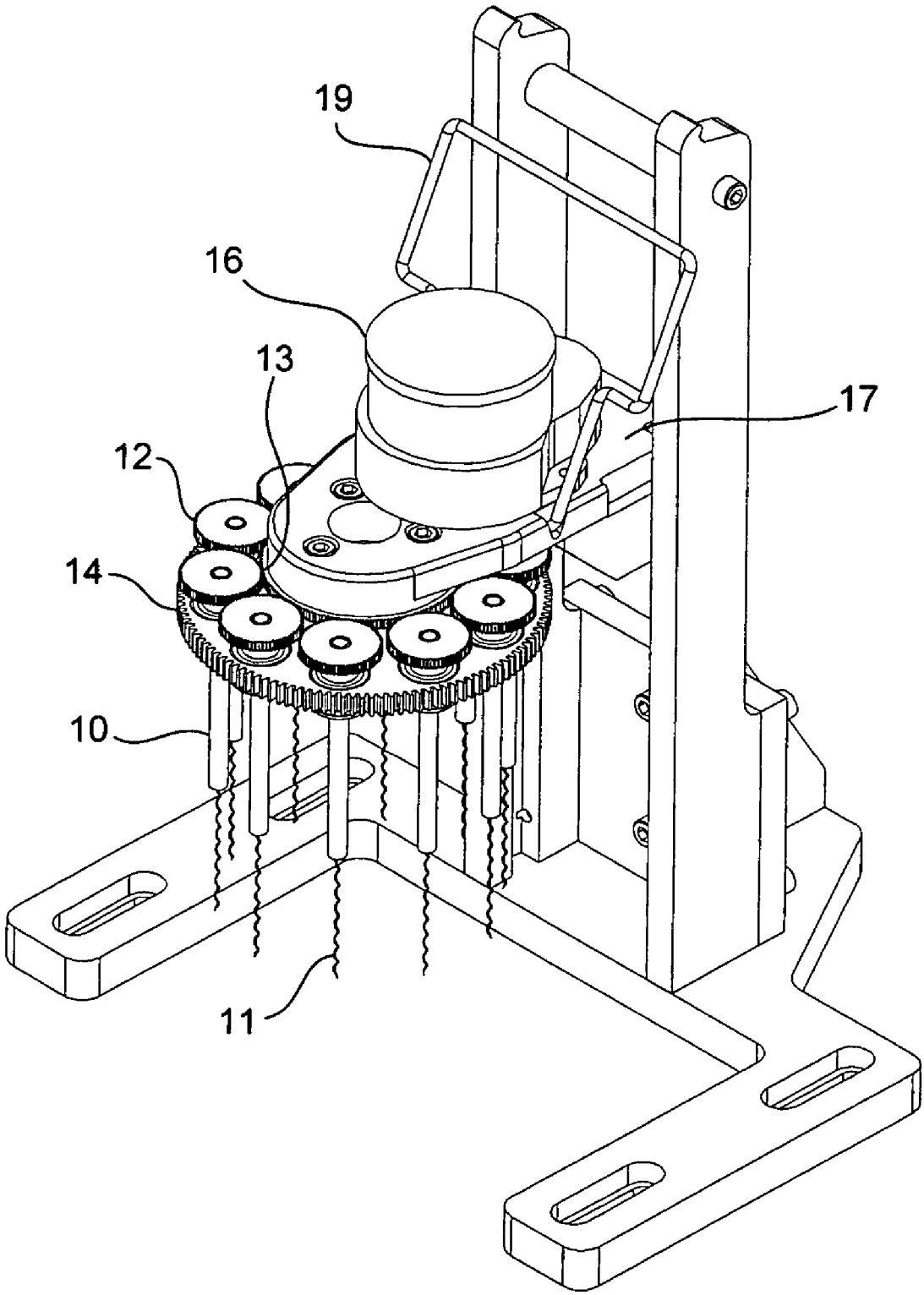
FIGS. 1A and 1B are perspective views of an apparatus according to the invention shown without the cathode and electrolytic solution container.
Figure 1B:
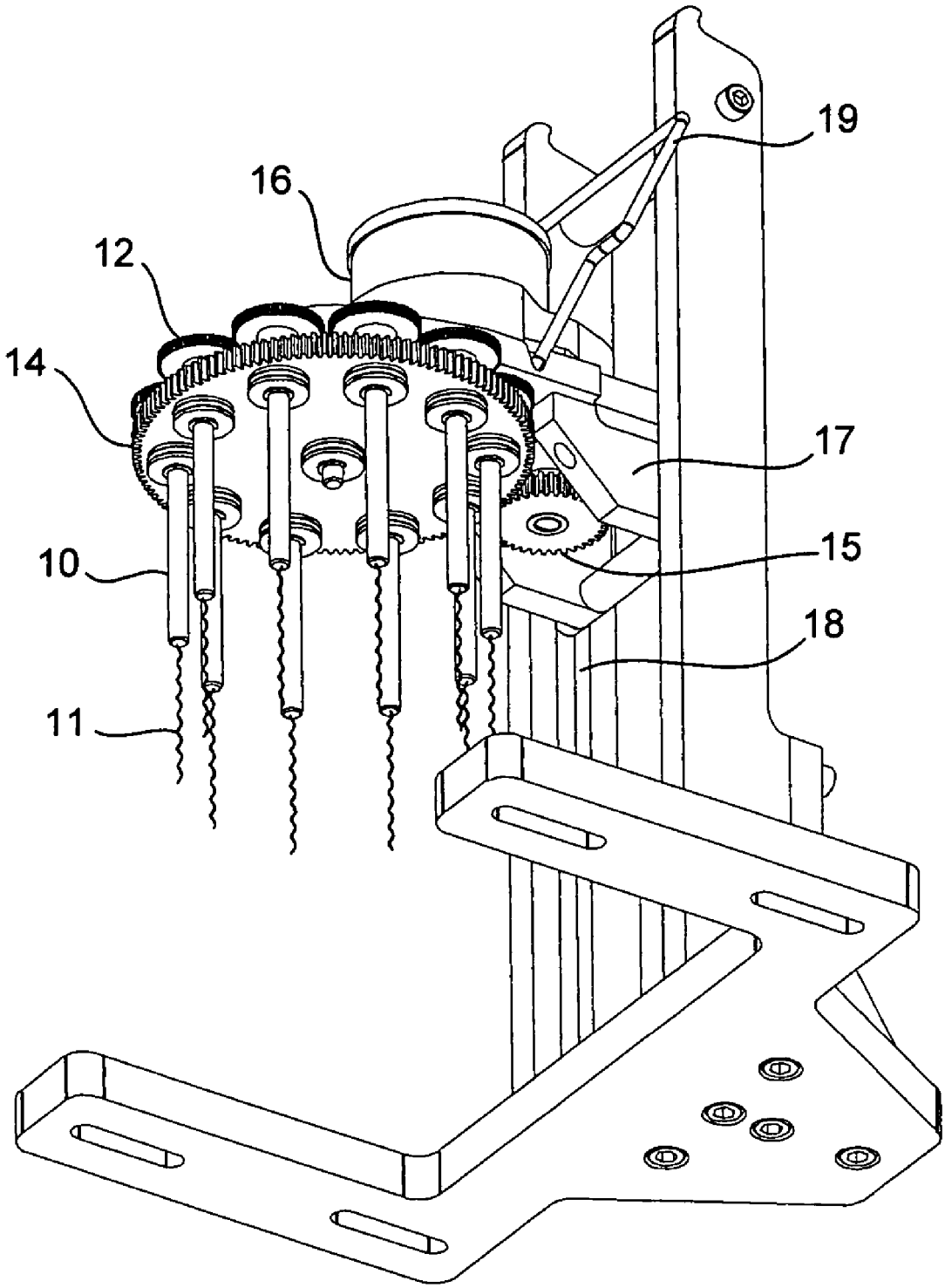

Referring to FIGS. 1A and 1B, there are shown top and bottom perspective views of an apparatus according to the present invention. For the purpose of clarity, the cathode and electrolytic solution container are not shown in these figures. The apparatus comprises a plurality of elongated members 10 in a downward orientation along a longitudinal axis. Each of the members 10 accommodates an electrically conductive adapter 11 which is capable of being removably affixed to and in electrical contact with a metallic stent as further described below.

At one end of the elongated members 10 there are respective toothed members 12 each engaged with toothed centrally placed stationary plate 13. Each of the members 10 is mounted to a movable toothed plate 14, which is driven by toothed member 15 connected to a motor 16. Each of the members 10 is freely rotatable along its own longitudinal axis. Thus, when toothed member 15 drives movable plate 14, the plurality of members 10 are moved in a circular motion within the electrolytic solution (not shown) at the same time toothed members 12 engaged with stationary plate 13 are also individually rotated. By rotation of the individual elongated members 10, a stent (not shown) attached to adapter 11, has all of its surfaces uniformly exposed to the cathode, which is a tubular structure, shown below, either larger than the circumference defined by the revolving members 10 or smaller than the circumference defined by the revolving members 10, or both, in the case of the two cathode embodiment described below. The apparatus in FIGS. 1A and 1B is also shown, for convenience, as being mounted on a supporting structure which conveniently allows for raising and lowering the stents into and out of the electrolytic solution. The elements 10-16 are all mounted on a support element 17, which slides along a pair of tracks 18, by using handle 19. All of the adapters 11 are in electrical contact with an anode current collecting member, such as a wire (not shown). For example, a wire lead may be attached to stationary plate 13, which is then in electrical contact with toothed elements 12 and adapters 11.

Figure 2:
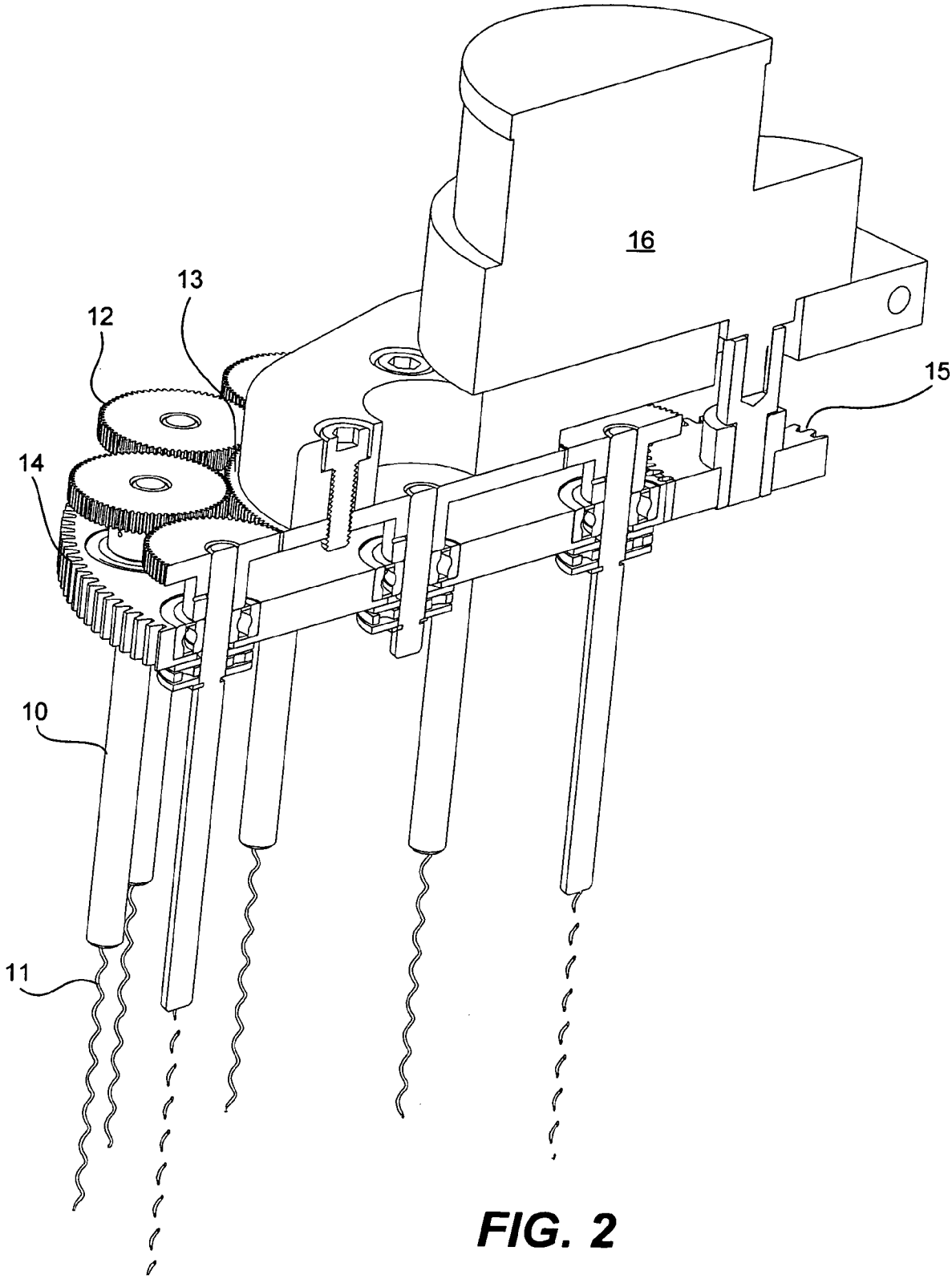
FIG. 2 is a partial cross-section showing the detail of a preferred embodiment of the mechanism for rotating stents of an apparatus according to the invention.

Referring to FIG. 2, there is shown a partial cut-away view to show the interconnection of elements 12 through 15. The drive element 15 drives the movable plate 14 which causes the toothed elements 12 to rotate by virtue of their engagement with stationary plate 13.

Figure 3:
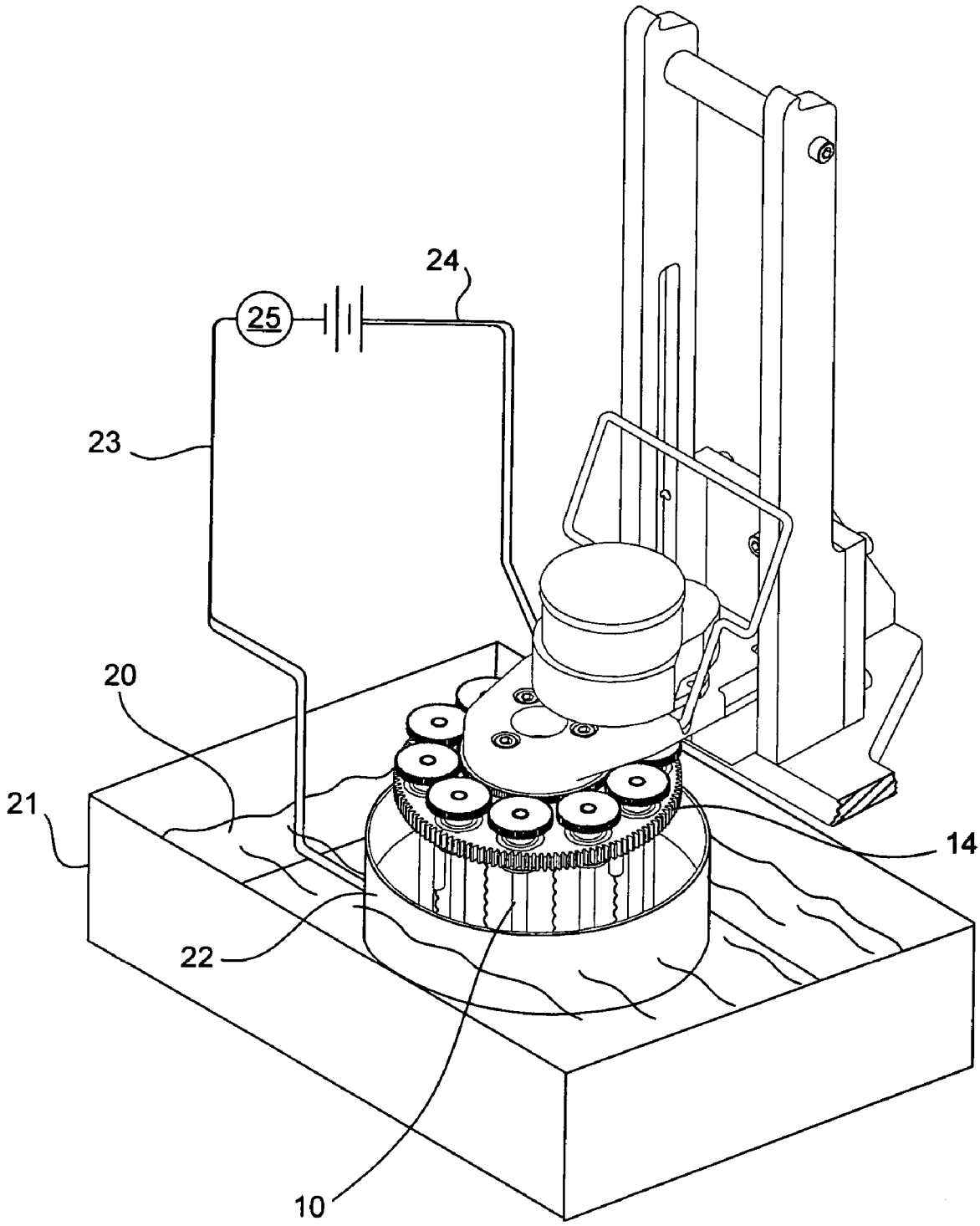
FIG. 3 is a view of an apparatus according to the invention showing the stents immersed in electrolytic solution and in close proximity to the cathode.

Referring to FIG. 3, there is shown an apparatus according to FIGS. 1A and 1B. With the elongated members 10 immersed in electropolishing solution 20 contained in a container 21, a tubular continuous cathode 22 is in close proximity with each of the elongated members 10. Each member 10 is substantially equidistant from the facing surface of the cathode 22. This provides for a consistent field to each of the stents as they, revolve with movable plate 14. Cathode 22 is attached to a cathode collecting member 23. The stents, as anodes, attached to elongated members 10 are all in electrical connection in series or parallel with anode current conducting member 24. Conducting members 23 and 24 are connected to an electromotive force (EMF)-providing DC source, such as a battery, from which current and/or voltage may be controlled by an appropriate controller 25.

Figure 4:
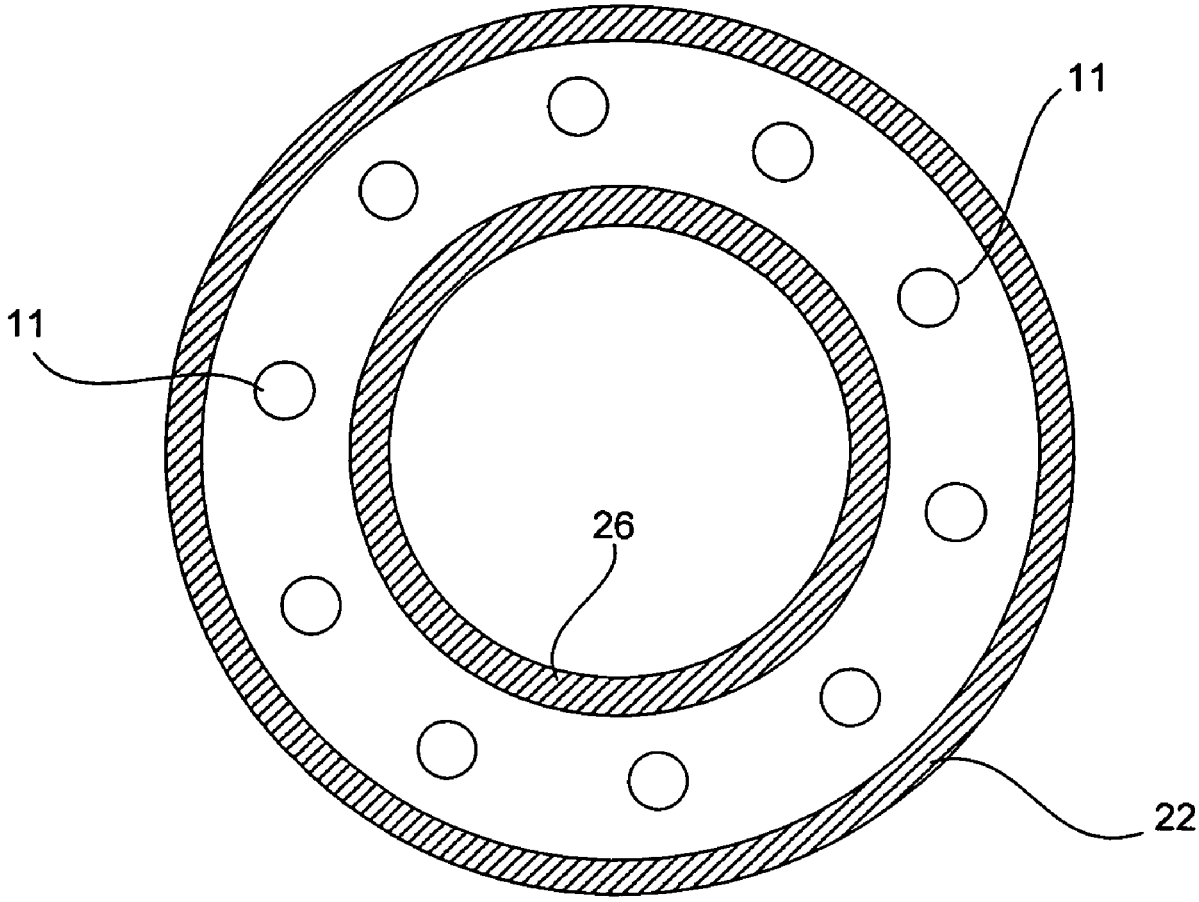
FIG. 4 is a top view of a configuration of an embodiment showing use of two cathodes on an apparatus according to the present invention.

Referring to FIG. 4, there is shown a top view of a two cathode configuration in which, in addition to the cathode 22 which is located outside the circumference defined by the revolving path of adapters 11, there is shown a second tubular cathode 26 having a circumference smaller than that of the circumference defined by the revolving adapters 11. Cathode 26 will also have a cathode current conducting number to supply electrons from the EMF source to the cathode.

Figure 5:
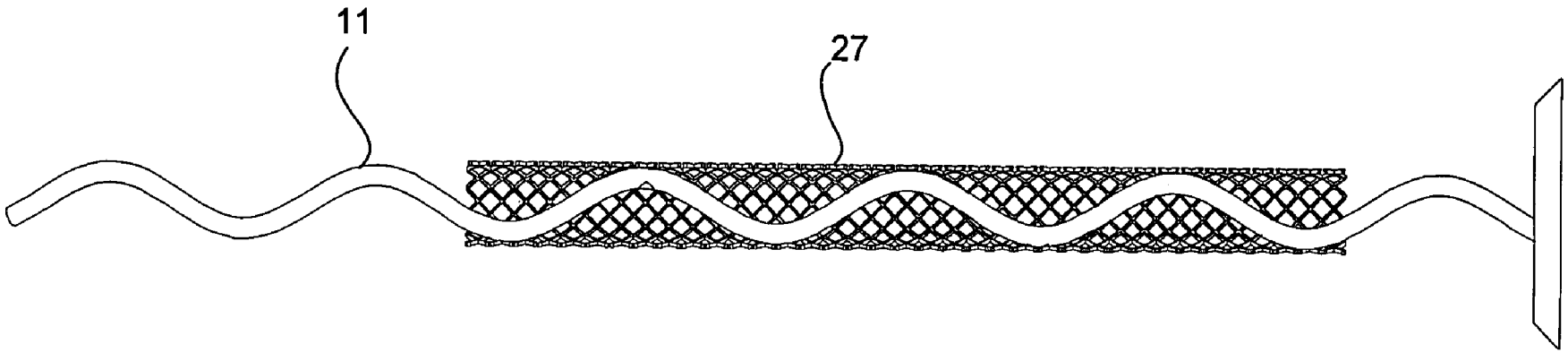
FIG. 5 is a detail showing a typical stent affixed to an electrically conductive adapter on an apparatus according to the present invention.

Referring to FIG. 5, there is shown the detail of adapter 11 to which a typical metallic stent 27 is affixed. The undulations or corkscrew diameter in the adapter 11 are predetermined such that the stents 27 of the desired size are slidably affixed, but securely retained on the adapter 11.

Typical coronary stents may vary in a range from about 7 to 40 millimeters in length with a diameter in a range of about 1 to 7 millimeters. However, stents of larger or smaller size may be suitably accommodated.

In order to accomplish the electropolishing process, the stents, preferably all identical in length and diameter and design, are placed on one or more of the adaptors 11. The mounted stents are then immersed into the electropolishing solution and while immersed, the motor, such as shown in FIG. 1, is activated which thereby revolves the moveable plate around its axis while each of the stents is independently rotated about its longitudinal axis in the electrolytic solution. An amperage is supplied to the stents, as anodes, and the cathode to electropolish the stents to the desired smoothness. Useful voltage may be in the range of about 20 to 40 volts, typically around 35±1 volt. Useful amperage may be about 1 to 2½ amps applied in about 20 to 60 second intervals. However, voltages and amperages outside of these ranges may also be useful, depending upon the number of stents, electrolyte and other design and process parameters.

In another configuration of the apparatus, the plate 14 may be stationary and the plate 13 may be mounted to be movable and driven by the motor 16. In such a configuration, the elongated members 10 will only rotate about their longitudinal axes, but will not revolve in the solution since plate 14 will be stationary.

It is desirable for the electropolishing process to be performed in stages. After one immersion in the electropolishing solution, typically lasting from about 20 to 60 seconds, the stents may be removed from the solution and washed, typically with alcohol. Then, the electropolishing may be repeated several times with each step followed by a rinse of the stents. Typically a suitable polishing process will comprise about four iterations of the electropolishing step. But more or fewer iterations may be suitable, depending upon the stents, electrolyte, voltage/amperage, speed of rotation and other process variations. Once the desired electropolishing is completed, the stents are removed from the electropolishing solution and from the electropolishing apparatus, rinsed and contacted with a passivation solution to ensure that no residual electropolishing solution remains on the stents. The stents are typically again rinsed and placed in a bath to which ultrasound energy is applied to complete the rinsing. A useful final rinse step will involve exposure for about two minutes in an ultrasound bath in the range of about 50 to 60° C.

A preferred electropolishing solution will comprise about 1 to 20 volume percent ethylene glycol, about 5 to 30 volume percent sulfuric acid and about 50 to 94 volume percent methanol. A useful electropolishing solution comprises about 4 volume percent ethylene glycol, about 10 volume percent sulfuric acid and about 86 volume percent methanol.

The following example is presented for the purpose of illustration and is not intended to limit the invention in any way.

EXAMPLE

Five dry identical stents are inserted onto five of the adapter on the receiver by sliding over the corkscrew or undulating contact points. While agitating the electropolishing solution (4 volume percent ethylene glycol, 10 volume percent sulfuric acid, 86 volume percent methanol) the stents are lowered on the apparatus into the electropolishing solution. The positive lead from the electrical source is attached to the apparatus and the motor is turned on to revolve and rotate the stents in the solution. When the cycle time has elapsed (depending on the size and type of stent) the stents are removed from the receiver and submerged in a container of methanol. Each stent is rotated while submerged. The stents are then re-immersed in the electropolishing solution for another polishing cycle. The polishing cycle is repeated between two to four polishing cycles. The stents removed from the adapters and placed into a purified water rinse for about 30 seconds. The stents are then removed and placed in Anapol PA/nitric acid passivation rinse bath for 2 minutes. The stents are removed from the bath and placed in a purified water bath for about 30 seconds. The stents are then placed in an ethanol rinse beaker and the beaker is placed in an ultrasonic bath to sonicate for about 2 minutes at around 55±5° C. The stents are then removed and strung onto a wire through the center of each stent and are dried with compressed air.

What is claimed is:

1. An apparatus for simultaneously electropolishing a plurality of metallic stents comprising:

a plurality of elongated members each having a longitudinal axis, each of said elongated members comprising a respective electrically conductive adaptor configured to be removably affixed to and in electrical contact with one of said metallic stents when said one of said metallic stents receives a corresponding one of said electrically conductive adaptors, wherein each of said elongated members is independently rotatable about the longitudinal axis thereof;

a first plate, each of said elongated members being moveably engaged with said first plate such that movement of said first plate relative to said elongated members causes each of said elongated members to rotate about the respective longitudinal axis thereof;

a moveable second plate having said elongated members mounted thereto, said moveable second plate configured to rotate about an axis substantially parallel to said longitudinal axes of said elongated members;

a motorized driver operable to drive said moveable second plate to rotate said elongated members and said stents collectively about said axis and to rotate each of said elongated members and said stents about the respective longitudinal axis;

a container configured to hold an electrolytic solution;

a continuous cathode configured to be located in close proximity to each of said elongated members when said elongated members and cathode are immersed in said electrolytic solution;

a cathode current conducting member attached to said cathode;

an anode current conducting member wherein each of said elongated members is conductively connected electrically with said anode current conducting member.

2. The apparatus according to claim 1 for wherein said second plate is moveable and is engaged with said motorized driver; and said elongated members are accommodated by the stationary first plate.

3. The apparatus according to any of claim 1 or 2 further comprising a second continuous cathode configured to be located in close proximity to each of said elongated members when said elongated members and cathode are immersed in said electrolytic solution; and a second cathode current conducting member attached to said second cathode.

4. The apparatus according to claim 3 wherein said cathodes are tubular in shape and disposed substantially concentrically in said solution.

5. A method of simultaneously electropolishing metallic stents comprising the steps of:

a) affixing a stent on each of a plurality of electrically conductive adaptors, each electrically conductive adaptor is coupled to a corresponding elongated member;

b) immersing said stents in an electrolytic solution;

c) rotating each of said elongated members about a respective longitudinal axis to rotate each stent about the longitudinal axis while also rotating each of said elongated members about a common rotation axis to rotate each stent about the common rotation axis; and d) electropolishing each stent while each stent is being rotated about the longitudinal axis and about the common rotation axis.

6. The method according to claim 5 further comprising the steps of removing said stents from the electrolytic solution;

rinsing said stents;

immersing said stents in a passivation solution;

removing said stents from said passivation solutions and rinsing said stents;

placing said stents in a liquid and applying ultrasound energy to said liquid.

7. The method according to claim 5 wherein said electrolytic solution comprises about 4 vol. % ethylene glycol, about 10 vol. % sulfuric acid and about 86 vol. % methanol.

8. The method according to claim 6 wherein said passivation solution comprises nitric acid.

9. The method according to claim 6 wherein said ultrasound energy is applied to said liquid at a temperature in the range of about 50° to 60° C.

10. The method according to claim 5 wherein each stent is substantially equidistant from a cathode.

11. An electropolishing apparatus for electropolishing a plurality of metallic stents, comprising: a support having a rotation axis; a plurality of elongated members carried by the support, each elongated member having a longitudinal axis and being independently rotatable the longitudinal axis, each elongated member including an electrically conductive adaptor configured to removably retain a corresponding one of the metallic stents thereon; a first engagement member engaging each elongated member; a motorized driver operable to drive the support to rotate the elongated members collectively about the rotation axis of the support, thereby individually rotating each elongated member about a corresponding one of the longitudinal axes thereof; a container configured to hold an electrolytic solution; a cathode extending about the elongated members when the elongated members and cathode are immersed in said electrolytic solution, wherein each elongated member is substantially equidistant from the cathode; and an electrical source electrically coupled to the cathode and each elongated members.

12. The electropolishing apparatus of claim 11 wherein the support comprises a gear.

13. The electropolishing apparatus of claim 11 wherein the engagement member comprises a gear.

14. The electropolishing apparatus of claim 11 wherein the cathode is substantially continuous.

15. The electropolishing apparatus of claim 11 wherein the each elongated member comprises a second engagement member engaging the first engagement member.

16. The electropolishing apparatus of claim 11 wherein the engagement member is stationary.

* * * * *